United States Patent [19]

Nagata et al.

[11] 3,977,619

[45] Aug. 31, 1976

[54] METHOD AND APPARATUS FOR WINDING A CONTINUOUS FABRIC ON A CYLINDER IN A ROLL FORM

[75] Inventors: Yasunori Nagata, Osaka; Hisakazu Ikui, Settsu; Takumi Kakiuchi, Settsu; Masahiro Mori, Settsu, all of Japan

[73] Assignee: Kanebo, Ltd., Tokyo, Japan

[22] Filed: Dec. 19, 1973

[21] Appl. No.: 426,023

[30] Foreign Application Priority Data

Dec. 25, 1972 Japan ..... 48-434

[52] U.S. Cl. ..... 242/67.1 R; 242/75.2

[51] Int. Cl.[2] ..... B65H 17/02; B65H 23/00

[58] Field of Search ..... 242/75.2, 75, 75.1, 242/65, 67.1-67.5, 66, 75.53; 68/8

[56] References Cited

UNITED STATES PATENTS

| | | | |
|---|---|---|---|
| 2,618,954 | 11/1952 | Dourdeville | 68/8 |
| 3,279,718 | 10/1966 | Arterton et al. | 242/67.1 R |
| 3,599,889 | 8/1971 | Pfeiffer | 242/66 |
| 3,604,649 | 9/1971 | Dorfel | 242/66 |
| 3,643,474 | 2/1972 | Schiffer | 68/8 |
| 3,670,980 | 6/1972 | Mukai et al. | 242/67.1 R |
| 3,687,389 | 8/1972 | Adams | 242/67.5 |
| 3,701,493 | 10/1972 | Welsch et al. | 242/67.5 X |
| 3,777,995 | 12/1973 | Funaioli | 242/65 X |

FOREIGN PATENTS OR APPLICATIONS

| | | | |
|---|---|---|---|
| 1,194,075 | 6/1970 | United Kingdom | 242/75 |

*Primary Examiner*—Stanley N. Gilreath
*Assistant Examiner*—John M. Jillions
*Attorney, Agent, or Firm*—Paul & Paul

[57] ABSTRACT

A method for winding a continuous fabric on a cylinder together with a wrapping cloth in which, as a preparatory step for carrying out the decatizing treatment of fabric, a press roller always urges the surface layer of the rolled fabric toward the axis of the cylinder, during the winding operation. The contact pressure of the press roller is gradually increased under a controlled condition so that the binding force created by an outer layer of fabric toward an adjacently inner layer of fabric can be maintained in a substantially uniform condition. To increase the contact pressure of the press roller, a pressure control device is applied to the winding apparatus.

7 Claims, 14 Drawing Figures

CONTACT PRESSURE OF THE PRESS ROLLER IN kg/cm2
0
1
2
3
4
200
400
600
DIAMETER OF A ROLLED FABRIC IN mm
A
B
C t/to
0
1.0
1.1
1.2
200
400
600
DIAMETER OF A ROLLED FABRIC IN mm
E
A'
B'
C'

METHOD AND APPARATUS FOR WINDING A CONTINUOUS FABRIC ON A CYLINDER IN A ROLL FORM

SUMMARY OF THE INVENTION

The present invention relates to an improved method and apparatus for winding a cloth on a cylinder together with a wrapping cloth in a roll form which is suitable for the decatizing treatment, more particularly, relates to an improved method and apparatus for winding a cloth together with a wrapping cloth in a roll form under a controlled pressure which works toward the axis of the cylinder so that uniform binding force is created between each two adjacent layers when the above-mentioned winding operation is completed.

As a preparatory process of decatizing treatment, which is the last step of the conventional finishing processes applied to worsted or woolen fabric, the fabric is wound on a cylinder in a roll shape and then the rolled fabric is subjected to the decatizing treatment. To wind a continuous fabric on a cylinder in a roll shape, the following method has been commonly applied. That is, the fabric is wound on a cylinder in a superimposed condition with a wrapping cloth, and during the winding operation, a suitable tension is imparted to the wrapping cloth. Further, a predetermined pressure toward the axis of the cylinder is imparted on the instant outer surface of the rolled fabric, which has already been wound on the cylinder during the winding operation, by urging of a press roller which contacts the above-mentioned instant outer surface.

It is understood that, when a rolled fabric is doffed from a winding apparatus, each layer of fabric has a strong tendency to radially expand, because the rolled fabric is formed under pressure which works toward the axis of the cylinder so that the fabric is wound in a compressed condition. However, the above-mentioned potential force to expand radially is always restricted by the outer layers of fabric. Consequently, a binding force, which works toward the inner layers of fabric, is created on each layer of fabric. Based on our repeated mill tests, if the conventional winding method is applied for making a rolled fabric, the above-mentioned binding force varies from layer to layer and this variation creates a serious undesirable influence upon the quality of fabric treated by the decatizing treatment.

For example, if the above-mentioned binding force varies, the thickness of the fabric after the decatizing treatment varies very much. Therefore, it is very important to wind the fabric on the cylinder in such a condition that the rolled fabric is formed under a control pressure which assures the creation of uniform binding force in the roller fabric after completion of the winding operation.

The principle object of the present invention is to provide a method and apparatus for winding a continuous fabric together with a wrapping cloth on a cylinder under a controlled condition whereby the variation of the binding force of the layers of fabric can be minimized.

According to the present invention, a press roller is utilized to impart a pressure under a controlled condition upon the instant outside surface of a roller fabric which has already been wound on the cylinder, during the winding operation. The above-mentioned pressure is gradually elevated so as to satisfy a predetermined condition, during the winding operation. The above-mentioned predetermined condition is selected so as to create the minimum variation of the above-mentioned binding force for assuring a uniform result from the decatizing treatment upon the continuous fabric.

Further objects and characteristic features of the present invention are hereinafter described with reference to the embodiments shown in the accompanying drawings.

DETAILED ILLUSTRATION OF THE INVENTION

For the sake of better understanding of the present invention, before entering into the illustration of the present invention in detail, the conventional winding method of continuous fabric is hereinafter illustrated with reference to the attached drawing FIG. 1. In the winding mechanism shown in FIG. 1, a rolled fabric 1, which has completed the decatizing treatment, is mounted on a pair of supporting brackets (not shown) in turnable condition. A cylinder 2, which is used for winding a continuous fabric, comprises a pair of flanges 2*a* and a core cylinder 2*b* sandwiched by the flanges 2*a* and a pair of end shafts 2*c*, 2*d* projected outward from the respective flanges 2*a*. These elements of the cylinder are provided with a common axis as shown in FIG.

Figure 3A:
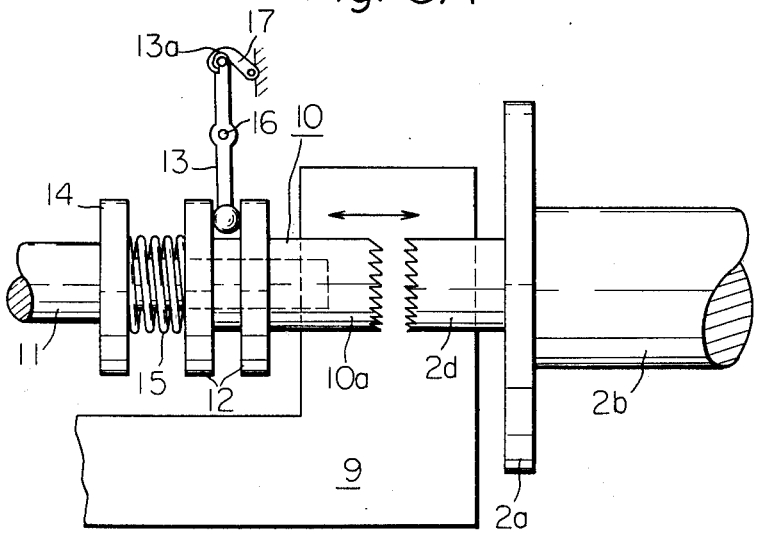
FIG. 3A is a schematic side view of an engaging mechanism for driving the cylinder shown in FIG. 2.
Figure 3B:
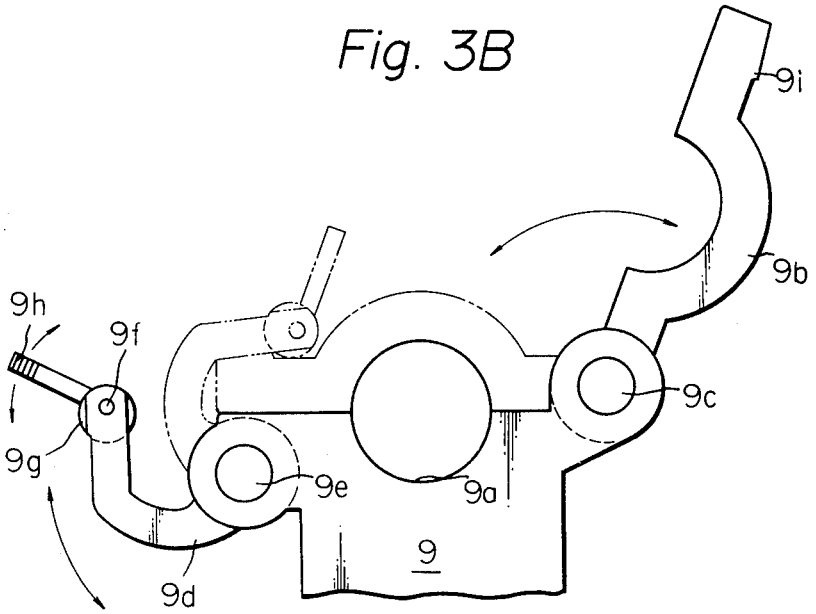
FIG. 3B is a perspective view of a supporting member for receiving an axis of the cylinder shown in FIG. 2.

2. The end shaft 2*d* is provided with a clutch formed at the outside terminal thereof. When the above-mentioned finished rolled fabric 1 is rotatably mounted on the abovementioned supporting brackets, the clutch 2*d* of the cylinder 2 is positioned so as to engage with a clutch (not shown) of a band brake which comprises a brake drum 3 and a brake band 4 partly in contact with the brake drum 3 and a tension spring 5 which pulls an end of the brake band 4 so as to create a brake force which is imparted to the brake drum 3. The other end of the brake band 4 is secured to a stationary bracket 6 of a machine frame (not shown), and a free end of the tension spring 5 is adjustably secured to another stationary bracket 7 by a nut 8. A fresh cylinder 2 is rotatably mouned on a pair of brackets 9 (one of which is shown in FIG. 3A) in such a condition that the clutch part 2*d* of the cylinder engages with a clutch of a spindle shaft which is driven by a driving shaft. The above-mentioned engaging mechanism for the fresh cylinder 2 is hereinafter explained in more detail. Referring to FIGS. 3A and 3B, each of the above-mentioned brackets 9 is divided into two parts, that is, an opened support 9*a* and a cover support 9*b*. The cover support 9*b* is turnably mounted on the opened support 9*a* by a pin shaft 9*c*. The cover support 9*b* is provided with an upward projection formed at a free end portion thereof. A fastening device 9*d* is turnably mounted to a part of the opened support 9*a* as shown in FIG. 3B and an eccentric roll 9*g* is turnably mounted to a free end portion of the fastening device 9*d* by a pin 9*f*. A grip piece 9*h* is secured to the eccentric roll 9*g* so that the roll 9*g* can be turned about the pin 9*f* by turning the grip piece 9*h*. The supports 9*a*, 9*b* are provided with a half cylindrical surface respectively so as to rotatably support the end shafts 2*c* or 2*d*. Therefore, when the fresh cylinder 2 is mounted on the supporting bracket 9, the cover support 9*b* should be opened as shown in FIG. 3B, and when the end shaft 2*c* or 2*d* is correctly positioned in the recess of the support 9*a*, the cover support 9*b* is turned counterclockwise (in FIG. 3B) so as to contact the free end portion thereof to the support 9*a*. Then the fastening device 9*d* is turned clockwise as shown in FIG. 3B to a position represented by a dotted line, and the grip piece 9*h* is turned so as to fasten the free end portion of the cover support 9*b* to the support 9*a*. The above-mentioned supporting mechanism is applied to the supporting bracket utilized in the rewinding mechanism shown in FIG. 1. A spline shaft 10 is mounted on an end portion of a driving shaft 11 in so-called spline engagement. The spline shaft 10 is provided with a pair of stationary flanges 12, secured to a free end portion thereof so as to receive an end of a clutch lever 13. The driving shaft 11 is also provided with a flange 14 which faces one of the flanges 12, and a helical spring 15 is mounted on the driving shaft 11 at an intervened position between flange 14 and the leftmost flange 12 as seen in FIG. 3A, so that the spline shaft 10 can be urged toward the cylinder 2 when the cylinder 2 is supported by the bracket 9. The clutch lever 13 is turnably mounted on a pivot shaft 16 and provided with a pin 13*a* which can be caught by a hook 17 turnably mounted to the machine frame (not shown) when the cylinder 2 is absent from the mounting position of the brackets 9. In other words, when a fresh cylinder 2 is turnably mounted on the brackets 9, the engagement of the hook 17 with the pin 13*a* is released so that the spline shaft 10 is displaced toward the cylinder 2, by the spring force of the helical spring 15 and, consequently, the clutch part of the spline shaft 10 engages with the clutch of the end shaft 2*d* of the cylinder 2. According to the above-mentioned clutch-engagement of the spline shaft 10 with the cylinder 2, the turning motion of the driving shaft 11 can be transmitted to the cylinder 2. The driving shaft 11 is driven by a driving mechanism 18 comprising a driving motor 19, a reduction gear box 20, a pair of pulleys 21*a*, 21*b* and an endless belt 22.

In the above-mentioned conventional apparatus, the winding up of a fresh continuous fabric 30 is commenced on the fresh cylinder 2 by way of a pair of guide rollers 25, 26 and a press roller 28. Before this winding operation, firstly a free end of the fabric 30 is secured to the core cylinder 2*b* of the cylinder 2 together with a free end of a wrapping cloth 24 which is unwound from the finished rolled fabric 1. The wrapping cloth 24 is unwound from the rolled fabric 1 and carried toward the press roller 28 via a guide roller 27, while the finished fabric 23 is unwound from the rolled fabric 1 and carried to take-up device (not shown) via a guide roller 29. The above-mentioned unwinding motion of the finished rolled fabric 1 is carried out by positively taking up the wrapping cloth 24. The tension of the wrapping cloth 24 can be adjusted by adjusting the fixing position of the spring 5 by the nut 8, in other words the tension of the wrapping cloth 24 is created by the braking action of the above-mentioned band brake. Further, in the above-mentioned conventional winding method, the press roller 28 always urges the rolled fabric 1*a* under a constant pressure. Consequently, the contact pressure of the press roller 28 against the outer layers if the rolled fabric influences the compactness of the rolled fabric and the potential property of radial expansion created in each layer of rolled fabric is gradually changed as the number of layers of the rolled fabric increases. When the rolled fabric 1*a* is taken off the winding apparatus, each layer of the rolled fabric 1*a* tends to expand radially, a force which binds the inner layers of fabric by an outer layer of fabric is created at each layer of fabric. Therefore the binding force of each layer of fabric is gradually changed from layer to layer so that a uniform result from the decatizing treatment cannot be expected.

Based on our repeated mill tests, it was concluded that the above-mentioned drawback of the conventional winding method can be eliminated by gradually changing the contact pressure of the press roller 28 under a controlled condition.

Therefore, in the present invention, the contacting pressure of the press roller 28 is gradually increased as the diameter of the rolled fabric increases. For the sake of better understanding, the winding mechanism according to the present invention is hereinafter illustrated in detail.

Figure 4:
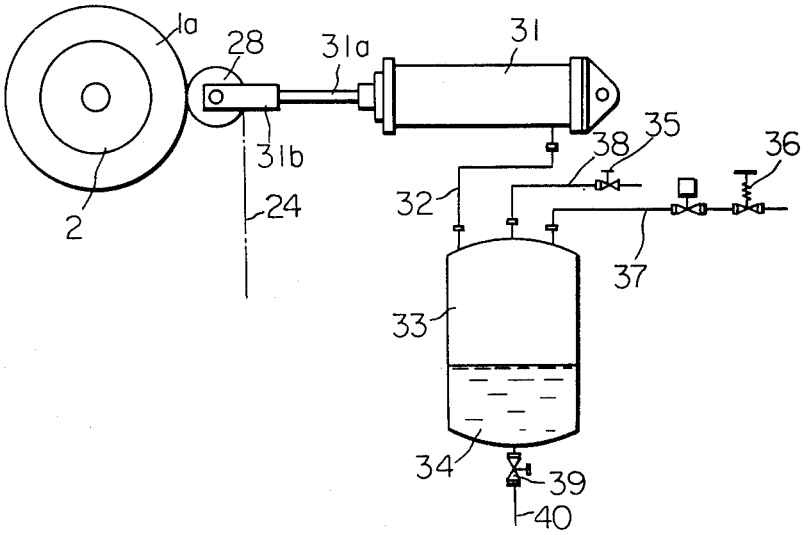
FIG. 4 is a schematic side view of a mechanism for imparting a pressure to a press roller which is utilized for the winding mechanism according to the present invention.

Referring to FIG. 4, the press roller 28 is connected to a pneumatic cylinder 31 via a piston rod 31*a* thereof and a bracket 31*b*. The press roller 28 is secured to an end of the piston rod 31*a* in rotatable condition, so that the press roller 28 presses the rolled fabric 1*a* under a contacting pressure created by the pneumatic cylinder 31. In the above-mentioned embodiment, an auxiliary chamber 33 is disposed on a supply conduit which connects the pneumatic cylinder 31 with a source of compressed air, that is, the cylinder 31 is connected to an intermediate supply conduit 32 which is connected to the chamber 33, while the chamber 33 is connected to a supply conduit 37 which is connected to the supply source of the compressed air. A discharge conduit 38 is connected to the chamber 33. Stop valves 35, 36 are mounted on the respective conduits 38 and 37. Compressed air having a pressure $P_o$ is fed into the chamber 33 and then the valve 36 of a supply conduit 37 is closed. According to the increasing diameter of the rolled fabric 1*a*, wherein a part of a continuous fabric is wound together with the wrapping cloth 24 in sandwiched condition, the press roller 28 is subjected to retract from the axis of the cylinder 2. Consequently a piston (not shown) of the pneumatic cylinder 31 is displaced toward the direction opposite the press roller 28 so that the air pressure in the compression side room of the pneumatic cylinder 31 is increased. According to the above-mentioned increase of the air pressure in the compression side room of the pneumatic cylinder 31, the contacting pressure of the press roller 28 upon the rolled fabric is increased. That is, the contacting pressure of the press roller 28 upon the rolled fabric 1*a* is directly influenced by the condition of the pneumatic cylinder 31. In this case, the capacity of air in the compression side room of the pneumatic cylinder 31 can be initially adjusted by filling part of the inside room of the auxiliary chamber 33 with water 34 which is a noncompressible fluid. That is, providing that, P is an inside pressure of the pneumatic cylinder 31 when the stroke of the piston rod 31*a* has changed an extent "R", the pressure P is represented by the following equation:

$$P = \frac{V + V_0 + A \cdot L}{V + V_0 + A(L - R)} P_0$$

$$= (1 + \frac{A \cdot R}{V + V_0 + A(L - R)}) P_0$$

wherein, V is the volume of a space for receiving air in the auxiliary chamber 33 and, therefore, V is constant as long as the amount of water in chamber 33 remains the same, $V_o$ represents the volumetric space of the conduit 32 connecting the tank 33 with the pneumatic cylinder 31 and, therefore, $V_o$ is constant, A is the cross-sectional area of the pneumatic cylinder 31, and L represents the maximum stroke of the piston rod 31*a* at the time of commencing the winding operation. As can be easily understood from the above-mentioned equation, the contact pressure of the press roller 28 increases as the diameter of the rolled fabric 1*a* is increased and the attitude of increase of the contacting pressure can be easily changed by changing the volume of water 34 in the tank 33. Further, the initial contacting pressure by the press roller 28 can be set at a desirable value by adjusting the valve 36. In the above-mentioned embodiment, water 34 is supplied by a supply pipe 38 provided with a closing valve 35 and water 34 in the tank 33 can be discharged via a conduit 40 by opening a discharge valve 39.

Figure 5:
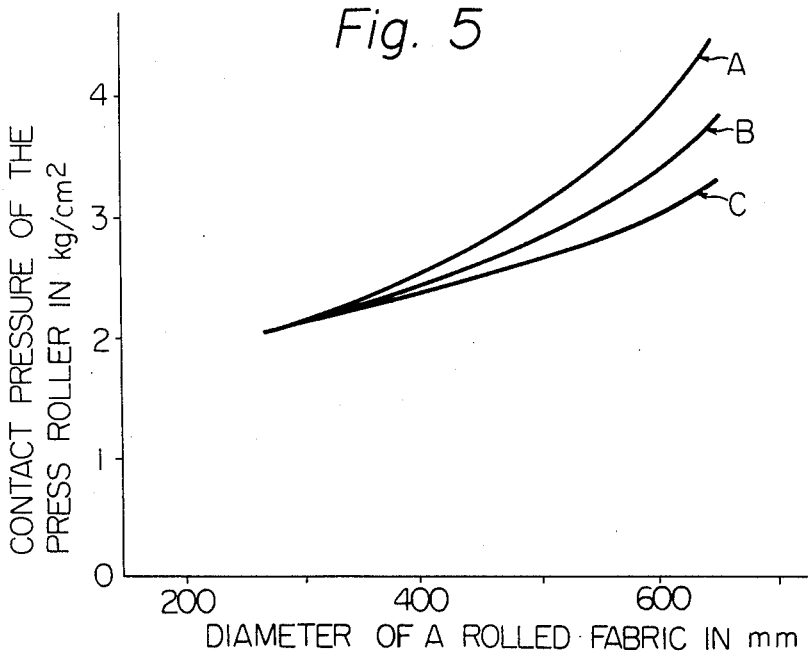
FIG. 5 is an explanatory diagram showing the relation between the contact pressure of the pressure roller and the diameter of a rolled fabric during the winding operation according to the present invention.

The diagrams shown in FIG. 5 represents the relationship between the diameter of a rolled fabric 1*a* and the contact pressure of the press roller 28, when a fabric is wound on a cylinder under the following conditions: Cylinder diameter D is 250 mm; maximum diameter of the rolled fabric is 650 mm; thickness and weight of the wrapping cloth are 0.87 and 430 g/m², respectively; fabric used is 100% worsted fabric (flano, thickness 0.74 mm, weight 330 g/m²). In the above-mentioned diagram, the contact pressure of the press roller 28 is represented by an inside pneumatic pressure of the pneumatic cylinder 31, $V_o$ is 100 cc, the initial inner pressure of the cylinder 31 is 2 kg/cm³, maximum stroke of the piston rod 31*b* is 30 cm and the cross sectional area of the auxiliary tank 33 is 50 cm². In the diagrams shown in FIG. 5, the A line represents a case where V is 200 cc, while the B line represents V at 500 cc and the C line represents V at 1000 cc.

Figure 6:
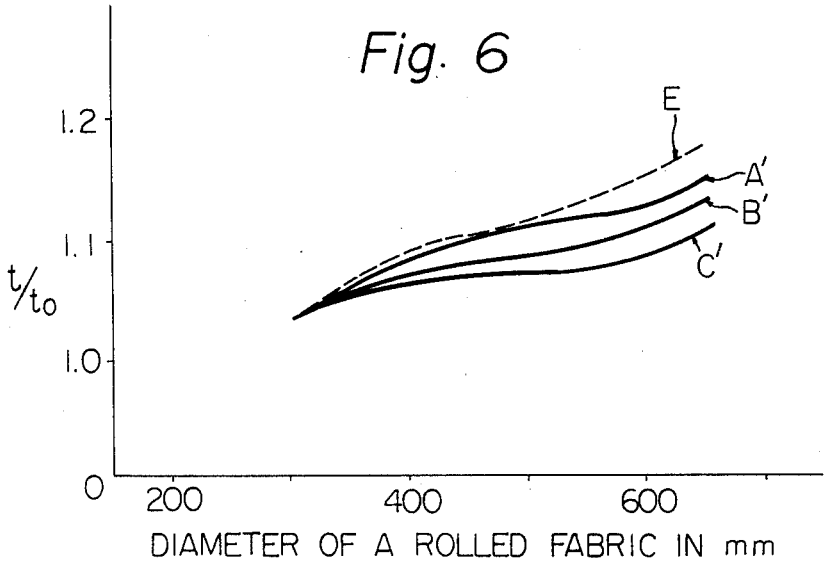
FIG. 6 is an explanatory diagram showing the relationship between a ratio (thickness of the fabric of each layer of the rolled fabric)/(thickness of the fabric of the most inside layer of the rolled fabric) and the diameter of each layer of the rolled fabric, made by the apparatus according to the present invention.

As already illustrated, the influence of the contact pressure of the press roller 28 upon the rolled fabric can be estimated by the variation of the thickness of fabric. The diagram shown in FIG. 6, represents the difference of thickness of the fabrics after decatizing treatment according to the conventional winding method and the present invention. In this diagram, the abscissa represents the diameter of the rolled fabric which represents layer of fabric, while the ordinate represents $t/t_o$, wherein $t_o$ is the thickness of the portion of the fabric which is positioned at the most inside layer of the rolled fabric, while $t$ is the thickness of the portion of the fabric which is positioned at any instant at the outside layer of the rolled fabric.

The identification A′ corresponds to the A line shown in FIG. 5, while B′ and C′ correspond to the B and C lines shown in FIG. 5. E represents the condition of the conventional method. Therefore, it is clear that the winding method according to the present invention is superior to the conventional method so far as the quality of the finished fabric is concerned.

Figure 1:
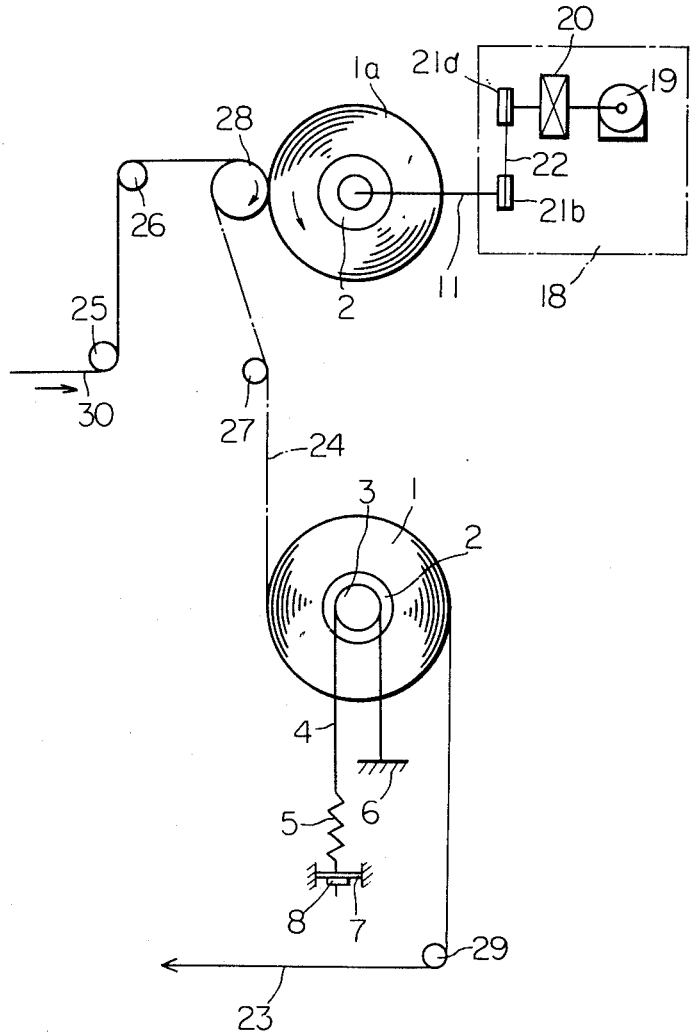
FIG. 1 is a skeleton sketch for showing a side view of a conventional mechanism for winding a continuous fabric with a wrapping cloth on a cylinder.
Figure 2:
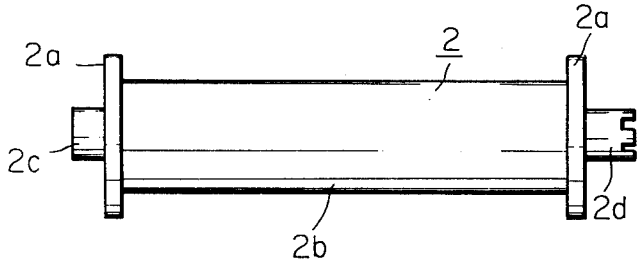
FIG. 2 is a schematic front view of a cylinder shown in FIG. 1.
Figure 7:
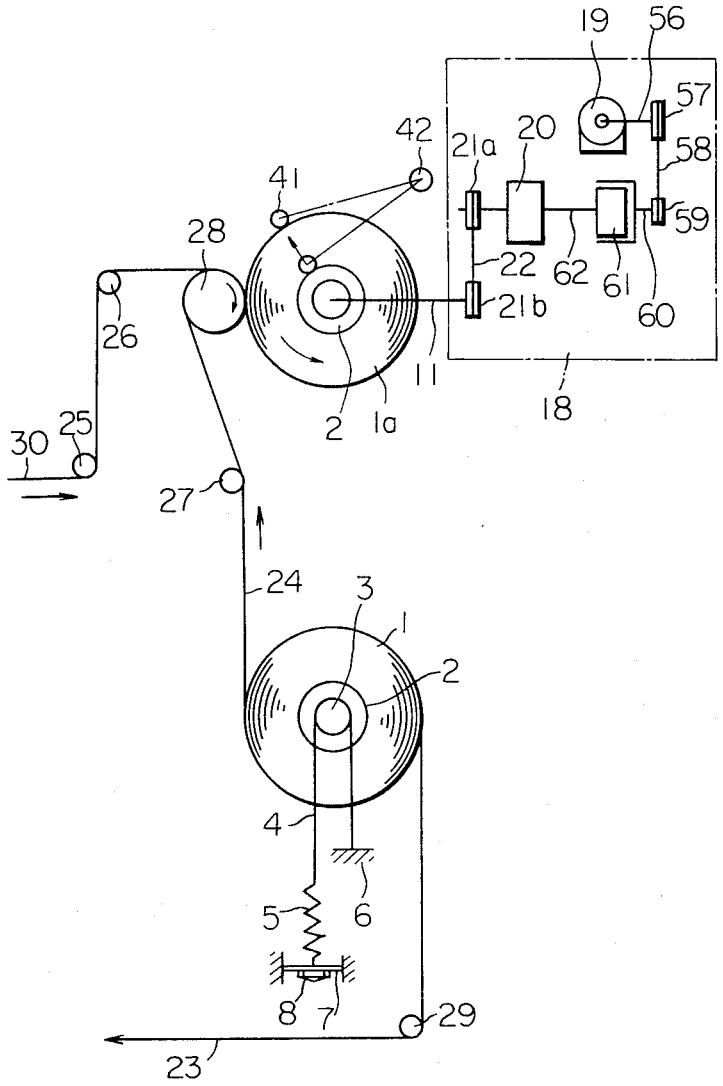
FIG. 7 is a schematic sketch of a side view of another embodiment of the present invention.
Figure 8:
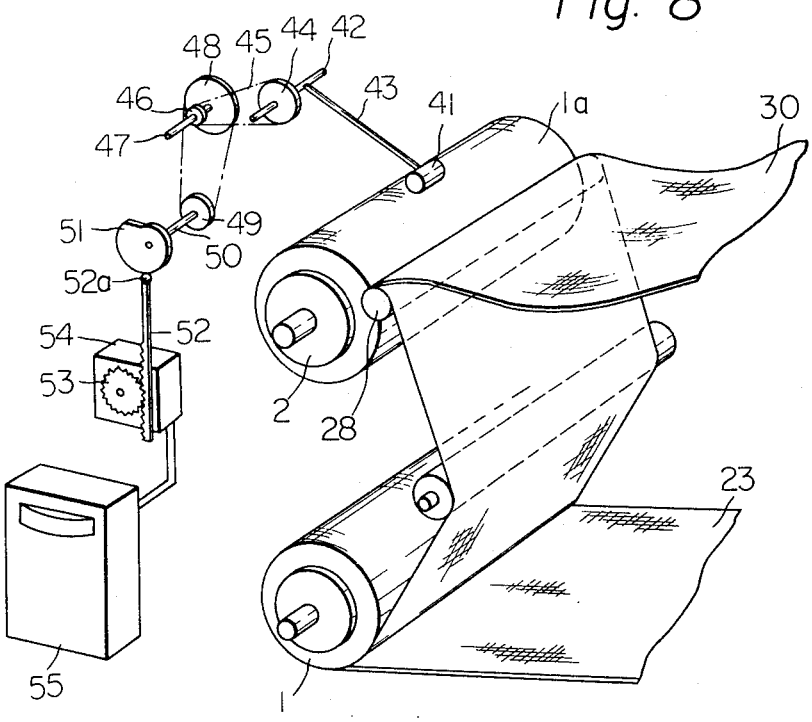
FIG. 8 is a perspective view of a part of the winding mechanism shown in FIG. 7.

A modified embodiment for winding a continuous fabric on a cylinder according to the present invention is shown in FIGS. 7 and 8 wherein the same component elements as in the embodiment shown in FIG. 1 are designated by the same reference numerals as the apparatus shown in FIG. 1. Therefore, the description of the common functions of these elements are omitted. In this embodiment, the main differences from the conventional apparatus are:

1. the speed for winding the fabric 30 on the cylinder 2 is controlled so as to be constant;
2. the contact pressure of the press roller 28 is gradually increased as the diameter of the rolled fabric 1*a* increases.

To carry out the above-mentioned control operation, the diameter of the rolled fabric 1*a* is always measured by a detecting mechanism which comprises a detecting roller 41 secured to a rod 43 which is rigidly mounted on a horizontal shaft 42. The shaft 42 is turnably supported by a stationary bracket (not shown) and, consequently, the shaft 42 is turned as the diameter of the rolled fabric 1*a* increases. At the end of the shaft 42, a sprocket wheel 44 is provided. Another sprocket wheel 46 is rigidly mounted on a horizontal shaft 47 turnably supported by another stationary bracket (not shown), and these sprocket wheels 44 and 46 are connected by an endless chain 45 so as to drive the sprocket wheel 46 by the turning motion of the sprocket wheel 44. Another sprocket wheel 48 is rigidly mounted on the shaft 47. A sprocket wheel 49 is rigidly mounted on a horizontal shaft 50 which is turnably supported by a stationary bracket (not shown). The above-mentioned stationary brackets are mounted to a machine frame. At the end of the shaft 50, a plate cam 51 is rigidly mounted. A verical rack 52 is slidably mounted to a stationary guide member which is secured to a machine frame (not shown). The rack 52 meshes with a pinion wheel 53 of a potentiometer 54 which is composed of a conventional mechanism.

A contact roller 52*a* of the rack 52 is always urged againt the cam surface of the plate cam 51. In the above-mentioned embodiment, the gear train is so designed that the plate cam 51 can be turned 300° when the rod 43 turns 15° together with the horizontal shaft 42, and the cam profile of the plate cam 51 is formed so as to actuate the potentiometer 54 which issues a signal corresponding to a predetermined program. An electric control device 55 is connected to the potentiometer 54.

Referring to FIGS. 7 and 8, the driving mechanism 18 is provided with auxiliary elements, that is, the driving motor 19 drives a pulley 57 secured to a motor shaft 56 and the driving motion of the pulley 57 is transferred to a pulley 59 secured to a shaft 60 by an endless belt 58. The input shaft 62 of the reduction gear box 20 is connected to the shaft 60 through a torque converter or a magnetic coupling 61 wherein a rotational slip between these shafts 60 and 62 can be controlled by an output signal of the potentiometer 54. Consequently, the driving speed of the shaft 11 is gradually reduced as the diameter of the rolled fabric 1*a* increases so as to maintain a constant speed of winding the fabric on the cylinder 2.

In this embodiment, the wrapping cloth 24 is unwound from the finished rolled fabric 1 and the tension of the wrapping cloth 24 is controlled by the band brake device which is illustrated in FIG. 1. However, a driving mechanism similar to the driving mechanism 18 can be applied for positive control of the rotational speed of the finished rolled fabric 1.

Figure 9:
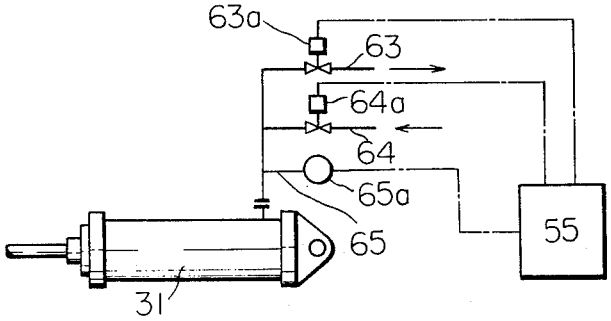
FIG. 9 is a skeleton sketch for showing a side view of another mechanism for adjusting the cylinder pressure of a loading mechanism according to the present invention.
Figure 10:
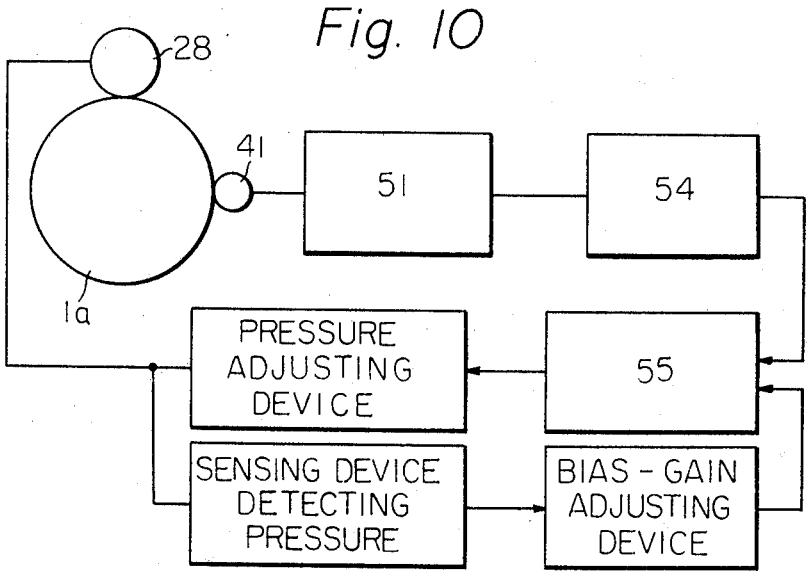
FIG. 10 is a block diagram of the control system for adjusting the cylinder pressure utilized for the loading mechanism of the present invention.

In the above-mentioned emboiment, when the potentiometer 54 issues a signal related to the instant diameter of the rolled fabric 1*a*, the signal is input to the controller 55 (see FIGS. 9 and 10). The pneumatic cylinder 31 is provided with a supply conduit 64 which supplies compressed air into the cylinder 31 and is provided with a valve 64*a* for closing or opening the conduit 64, a discharge conduit 63 which discharges compressed air from the cylinder 31 and is provided with a valve 63*a* for closing or opening the conduit 63, and a detecting conduit 65 which is provided with a device for detecting the pneumatic pressure of the cylinder 31. The output signal of the detector 65*a* is transferred to the controller 55. In the controller 55, the output signal of the potentiometer 54 is compared with the output signal of the detector 65*a* so that the actual pneumatic pressure in the cylinder 31 is always compared with the output signal of the potentiometer 54 which is predetermined by the cam profile of the plate cam 51. As the electric circuit of the above-mentioned controller, a conventional circuit system can be satisfactorily applied. When the controller 55 detects any difference between the output signal of the potentiometer 54 and the output signal of the detector 65*a*, the controller 55 issues a signal to actuate either one of the valves 63*a* or 64*a* according to the result obtained by the above-mentioned comparison so as to regulate the pneumatic pressure of the cylinder 31 according to the predetermined program. In other words, if it is detected that the actual pressure in the cylinder 31 is higher than the predetermined value, the value 63*a* is opened and, on the other hand, if the actual pressure in the cylinder 31 is lower than the predetermined value, the valve 64*a* is opened so as to supply compressed air into the cylinder 31. Consequently, the contact pressure of the press roller 28 can be gradually changed so as to conform to the program.

In the above-mentioned embodiment, these valves 63*a*, 64*a*, are so-called magnetic stop valves which can be easily opened or closed by the respective electric signal issued from the controller 55.

As already shown in FIGS. 5 and 6, the desirable condition of the contact pressure between the press roller 28 and the rolled fabric 1*a* is gradually elevated. Therefore, it is important to predetermine the contact pressure elevation curve in relation to the increase in the diameter of the rolled fabric so as to attain the purpose of the present invention.

Figure 11:
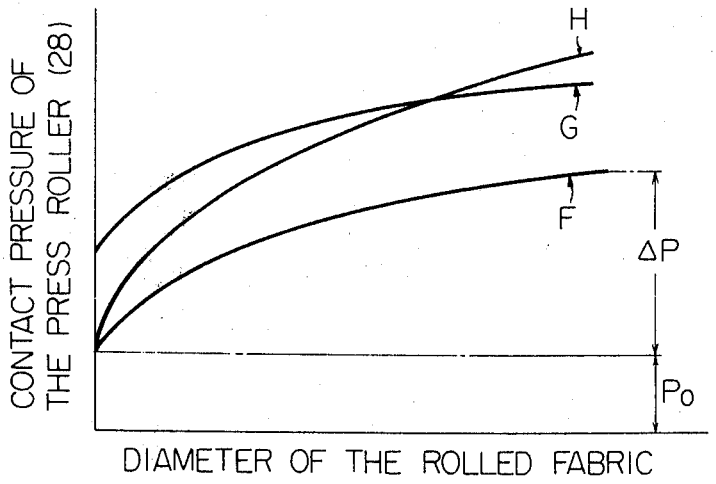
FIGS. 11 and 12 are diagrams showing the relation between the contact pressure of the press roller and the diameter of the rolled fabric during the winding operation in accordance with the present invention.

FIG. 11 represents the relationship between the diameter of the rolled fabric (abscissa) and an inside pressure of the pneumatic cylinder 31 (ordinate), by which the function of the bias-gain adjusting device can be illustrated. That is, in the case of where the actual level of the pressure is required to be set at a higher level than the level defined by the program F (this case is represented by a curve G), it is sufficient that negative bias, which is lower than the level of the adjusting device, be applied to attain the purpose. And in the case wherein it is desired to attain the control effect represented by a curve H, it is possible to create an initial pressure $P_o$ with an allowance of variation $\Delta P$, by adjusting the gain of the output of the detector 65*a* by the adjusting device.

EXAMPLE

Figure 12:
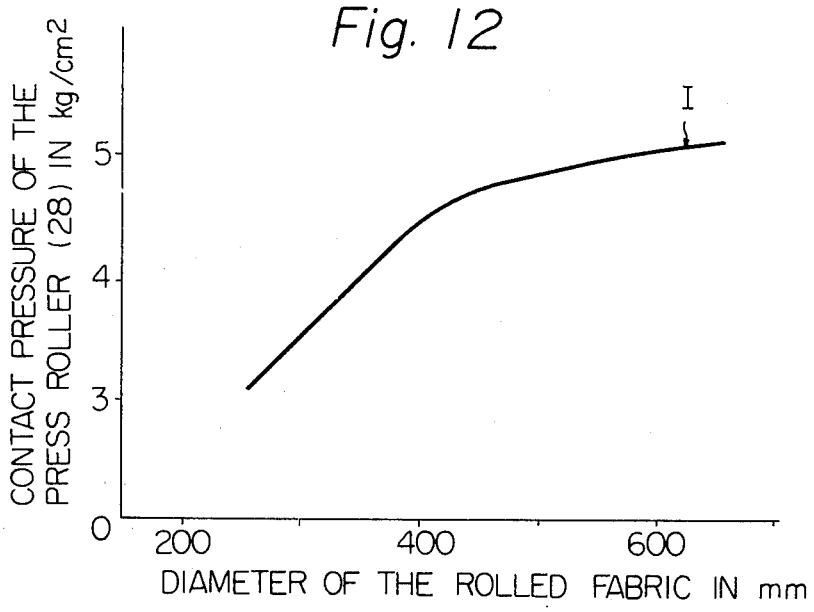
Figure 13:
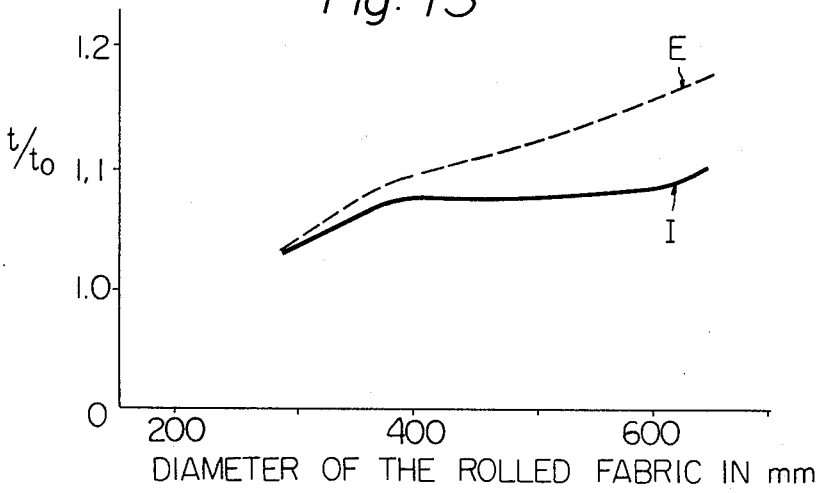
FIG. 13 is an explanatory diagram indicating variation of the fabric thickness in accordance with the increase of the instant diameter of the rolled fabric during the winding operation.

The contact pressure of the press roller 28 is programed as shown in FIG. 12, and the cam profile of the plte cam 51 and the condition of the bias-gain adjusting device are designed so as to satisfy the condition shown in FIG. 12. In this case, the fabric (flano, thickness of fabric is 0.74 mm, weight of the fabric is 330 g/m$^2$) is wound on a core cylinder of 250 mm diameter, together with a wrapping cloth (thickness is 0.8 mm, weight 430 g/m$^2$), and the final diameter of the rolled fabric is 650 mm. Thereafter, the rolled fabric is subjected to the decatizing treatment. FIG. 13 represents the comparison between the variation of thickness of the fabric would by the above-mentioned method and the conventional method. As shown in FIG. 13, the variation of thickness along the longitudinal direction of the finished fabric according to the present invention (which is represented by I) is remarkably smaller than that of the conventional method (which is represented by E).

What is claimed is:

1. In a system for winding a continuous fabric on a cylinder with a wrapping cloth wound therewith, apparatus for maintaining said fabric in a state of uniform tension comprising:

means for providing variable pressure against the outer winding of said fabric, including a press roller, a pneumatic cylinder urging said press roller against said fabric, an air inlet, and outlet valves for the compression chamber of said cylinder;

means for sensing the present diameter of fabric and cloth wound on said cylinder;

means for sensing the present pneumatic pressure in said chamber;

means for generating a first signal as a predetermined function of the sensed present diameter;

means for generating a second signal as a predetermined function of the sensed present pneumatic pressure;

means for developing a control signal as a predetermined function of said present diameter and said present pneumatic pressure, said means for developing operating responsively to the difference between said first and second signals; and means for actuating said valves, in response to said control signal, thereby controlling the pressure of said press roller against said cylinder.

2. In a system for winding a continuous fabric on a cylinder with a wrapping cloth wound therewith, a method for maintaining said fabric in a state of uniform tension comprising the steps of:

providing pressure against the outer winding of said fabric by establishing pneumatic pressure in a pneumatic cylinder urging a press roller against said fabric;

sensing the present diameter of fabric and cloth wound on said cylinder;

sensing the present pneumatic pressure in said cylinder;

generating a first signal as a predetermined function of the sensed present diameter;

generating a second signal as a predetermined function of the sensed present pneumatic pressure;

developing a control signal as a predetermined function of said present diameter and said present pneumatic pressure, said control signal being developed in response to the difference between said first and second signals; and actuating pressure changes corresponding to changes in said control signal.

3. In a system for winding a continuous fabric on a cylinder with a wrapping cloth wound therewith, apparatus for maintaining said fabric in a state of uniform tension comprising:

means for providing gradually increasing pressure against the outer winding of said fabric, including a press roller, a pneumatic cylinder urging said press roller against said fabric, an air inlet, and outlet valves for the compression chamber of said cylinder;

means for sensing the present diameter of fabric and cloth wound on said cylinder;

means for sensing the present pneumatic pressure in said chamber;

means for developing a control signal as a predetermined function of said present diameter and said present pneumatic pressure, said predetermined function being characterized by an exponential curve relationship between said increasing pressure and said present diameter of rolled fabric; and means for actuating said valves, in response to said control signal, thereby controlling the pressure of said press roller against said cylinder in accordance with said function.

4. In a system for winding a continuous fabric on a cylinder with a wrapping cloth wound therewith, a method for maintaining said fabric in a state of uniform tension comprising the steps of:

providing increasing pressure against the outer winding of said fabric by establishing pneumatic pressure in a pneumatic cylinder urging a press roller against said fabric;

sensing the present diameter of fabric and cloth wound on said cylinder;

sensing the present pneumatic pressure in said cylinder;

developing a control signal as a predetermined function of said present diameter and said present pneumatic pressure, said predetermined function being characterized by an exponential curve relationship between said increasing pressure of the press roller and said present diameter of rolled fabric; and actuating pressure changes corresponding to changes in said control signal.

5. Apparatus for winding a continuous fabric with uniform tension on a cylinder together with wrapping cloth comprising:

a roller mounted on a pivotable arm, said roller riding on the outer winding of fabric on said cylinder;

a cam of predetermined configuration and rotatable in accordance with pivotable movement of said arm, said cam being configured to afford an exponential curve relationship between the control pressure of said press roller and said diameter of rolled fabric, for imparting increasing contact pressure of said contact roller to said outer winding of fabric;

a rack and pinion, said rack bearing against said cam and movable laterally, in response to cam rotation, to rotate said pinion;

an air cylinder having a compression chamber therein and a piston means for exerting pressure against said chamber;

a contact roller mounted on said piston means and bearing against said outer winding of fabric; and control means, responsive to the position of said pinion, for regulating the air pressure in said compression chamber as an intermediate variable, thereby regulating pressure between said roller and said cylinder as an end variable.

6. Apparatus as described in claim 5, wherein said control means comprises:

means for generating a predetermined signal as a function of variable positions of said pinion;

actuation means, responsive to said signal, for adjusting said air pressure;

means for detecting the actual pressure in said chamber; and bias means for adjusting said signal level to compensate for variations in said actual pressure.

7. Apparatus as described in claim 6, wherein said compression chamber is supplied by input and outlet valves, said valves being respectively operated by said actuation means to vary said air pressure.

* * * * *